US011831117B2

(12) United States Patent
Chen et al.

(10) Patent No.: US 11,831,117 B2
(45) Date of Patent: Nov. 28, 2023

(54) CONDUCTIVE TERMINAL AND CONNECTOR

(71) Applicant: Tyco Electronics (Shanghai) Co. Ltd., Shanghai (CN)

(72) Inventors: Bo (Leo) Chen, Shanghai (CN); Hongbo (Daniel) Zhang, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 17/372,980

(22) Filed: Jul. 12, 2021

(65) Prior Publication Data

US 2022/0021132 A1 Jan. 20, 2022

(30) Foreign Application Priority Data

Jul. 15, 2020 (CN) ..... 202010679801.0

(51) Int. Cl.
*H01R 4/18* (2006.01)
*H01R 13/58* (2006.01)
*H01R 13/11* (2006.01)

(52) U.S. Cl.
CPC ..... *H01R 4/184* (2013.01); *H01R 13/112* (2013.01); *H01R 13/58* (2013.01)

(58) Field of Classification Search
CPC .. H01R 13/2457; H01R 13/112; H01R 13/58; H01R 4/184
See application file for complete search history.

(56) References Cited

U.S. PATENT DOCUMENTS 5,664,969 A * 9/1997 Peterson ..... H01R 13/432 439/752.5
6,402,571 B1 * 6/2002 Muller ..... H01R 13/18 439/856
7,291,046 B2 * 11/2007 Russelburg ..... H01R 43/16 439/857
10,855,017 B2 * 12/2020 Nakazono ..... H01R 13/432
2007/0178775 A1 * 8/2007 Morello ..... H01R 13/11 439/877
2017/0170591 A1 * 6/2017 Uezono ..... H01R 13/40

FOREIGN PATENT DOCUMENTS

DE 10314227 A1 * 10/2004 ..... H01R 13/112

* cited by examiner

*Primary Examiner* — Briggitte R. Hammond
(74) *Attorney, Agent, or Firm* — Barley Snyder

(57) ABSTRACT

A conductive terminal adapted to be installed in an insulative housing of a connector comprises a mating portion located at a front of the terminal for engaging with a terminal of a mating connector, and a crimping portion located at a rear of the terminal for crimping to a wire. A blocking portion of the terminal is located between the mating portion and the crimping portion and engages with the insulative housing to constrain the movement of the conductive terminal in the housing in a longitudinal direction and in a direction perpendicular to the longitudinal direction.

17 Claims, 5 Drawing Sheets

CONDUCTIVE TERMINAL AND CONNECTOR

CROSS-REFERENCE TO RELATED APPLICATIONS

This application claims priority under 35 U.S.C. § 119 to Chinese Patent Application No. 202010679801.0 filed on Jul. 15, 2020, the entire disclosure of which is incorporated herein by reference.

FIELD OF THE INVENTION

The present disclosure relates to conductive terminals and to electrical connectors including the same.

BACKGROUND

According to the prior art, a conductive terminal of a wire-terminal connector is typically crimped to a wire, and subsequently assembled into an insulative housing. Generally, there is no fixing structure between the conductive terminal and the insulating housing once installed. As a result, the conductive terminal is subject to displacement (e.g., wobble) in vertical and longitudinal directions. Therefore, in the process of assembling the conductive terminal and mating the male and female connectors, the conductive terminal is likely to be skewed, which in turn leads to poor conductivity and therefore decreased performance.

SUMMARY

According to an embodiment of the present disclosure, a terminal for installing in an insulative housing of a connector comprises a mating portion located proximate a front of the terminal for engaging with a terminal of a mating connector, and a crimping portion located proximate a rear of the terminal for crimping to a wire. A blocking portion of the terminal is located between the mating portion and the crimping portion and engages with the insulative housing to constrain the movement of the conductive terminal within the housing in a longitudinal direction and in a direction perpendicular to the longitudinal direction.

BRIEF DESCRIPTION OF THE DRAWINGS

The invention will now be described by way of example with reference to the accompanying Figures, of which.

DETAILED DESCRIPTION OF THE EMBODIMENTS

Figure 1:
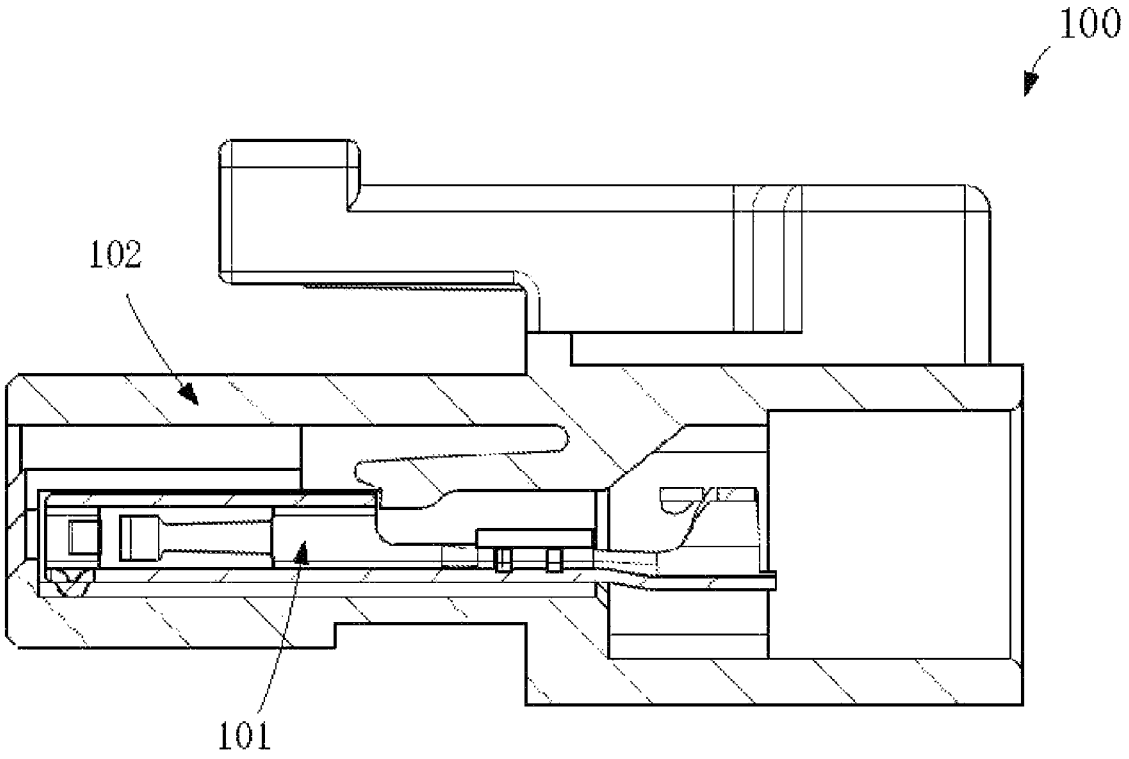
FIG. 1 PRIOR ART
FIG. 1 is a schematic view illustrating a connector including a conductive terminal and an insulating housing according to the prior art.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

FIG. 1 illustrates a schematic view of a connector 100 including a conductive terminal 101 and an insulating housing 102 according to the prior art. As shown in FIG. 1, the conductive terminal 101 is assembled into the insulating housing 102 of the connector 102 after being crimped. As shown, there is no fixing structure between the conductive terminal 101 and the insulating housing 102. In this way, the conductive terminal 101 is unable to be fixed in the insulating housing 102, and is subject to displacement in up and down directions or in front and rear directions. Therefore, in the process of assembling the conductive terminal and mating the male and female connectors, the conductive terminal is likely to be skewed, which in turn leads to poor conductivity of the conductive terminal. In view of the above problem, the present invention provides an improved conductive terminal, insulative housing of a connector, and connector including a conductive terminal and an insulative housing.

Figure 2:
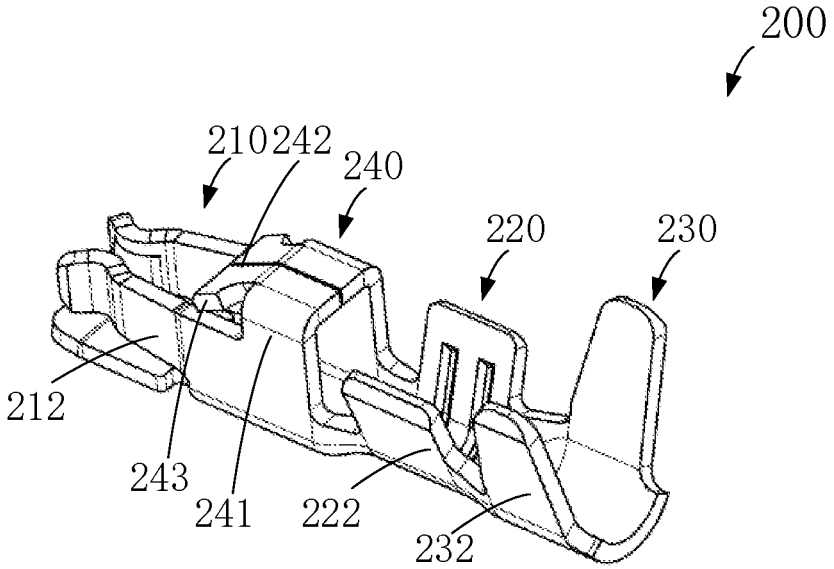
FIG. 2 is a perspective view of a conductive terminal according to embodiments of the present invention.
Figure 3:
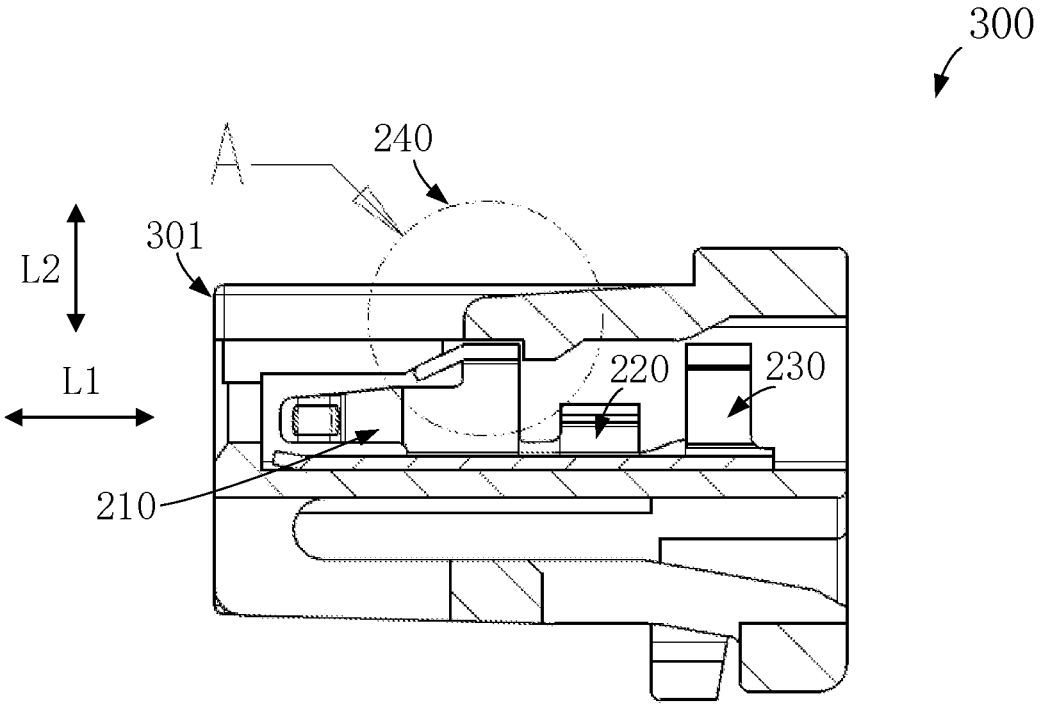
FIG. 3 is a cross sectional view of an insulating housing of a connector and its cooperation with a conductive terminal according to embodiments of the present invention.
Figure 4:
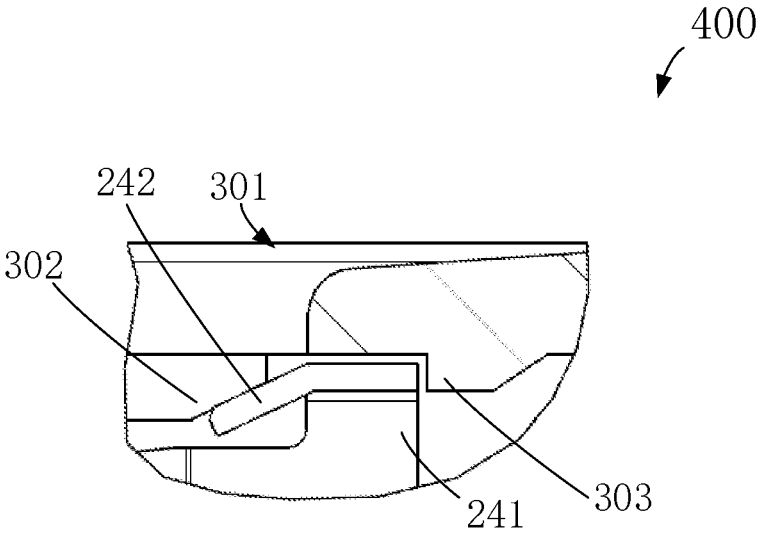
FIG. 4 is an enlarged fragmented sectional view of the conductive terminal of FIGS. 2 and 3 according to embodiments of the present invention.

FIG. 2 illustrates a perspective view of a conductive terminal 200 according to embodiments of the present invention. FIG. 3 illustrates a cross sectional view of an insulating housing 301 of a connector 300 and its cooperation with the conductive terminal 200 of FIG. 2 according to embodiments of the present invention. FIG. 4 illustrates an enlarged fragmented sectional view 400 of the conductive terminal of FIGS. 2 and 3 according to embodiments of the present invention.

As shown in FIGS. 2 and 3, in the illustrated embodiment, the conductive terminal 200 is adapted to be installed in the insulating housing 301 of the connector 300. The conductive terminal 200 includes a mating portion 210 and crimping portions 220, 230. The mating portion 210 is located at the front of the conductive terminal 200 and adapted to mate with a mating terminal of a mating connector. The crimping portions 220, 230 are located at the rear of the conductive terminal and are adapted to crimp a wire.

The conductive terminal 200 further includes a blocking portion or protrusion 240. The blocking portion 240 is located between the mating portion 210 and the crimping portions 220, 230 and adapted to cooperate with the insulative housing 301 to constrain the movement of the conductive terminal 200 along a longitudinal direction (a direction L1 as illustrated, which is for example the length direction of the conductive terminal 200) and a direction perpendicular to the longitudinal direction (a direction L2 as illustrated, which is for example the height direction of the conductive terminal 200) in the insulative housing 301.

The blocking portion 240 includes a first portion or protrusion 241 extending from at least one of either side of the conductive terminal 200. For example, the first portion 241 may be formed by extending a wall substantially vertically upward from the base of the conductive terminal 200, or the first portion 241 may be formed by extending from the base of the conductive terminal 200 in other directions or angles. The blocking portion 240 further comprises a second portion or tab 242 extending from the first portion 241, and at least a part of the second portion 242 is arranged at an angle to the first portion 241. For example, at least the part of the second portion 242 may include an oblique or tilted surface arranged at a tilt angle (e.g., less than 90 degrees) relative to the first part 241. In this way, the second portion 242 opposes an interior surface of the insulative housing 301 in at least two directions L1 and L2 (i.e., in a direction of insertion of the terminal and in a vertical direction).

As shown in FIGS. 3 and 4, in the illustrated embodiment, an outer surface of the second portion 242 is adapted to cooperate with an inner surface of the insulative housing 301. As shown, the inner surface of the insulative housing 301 defines a first cooperation portion 302 and a second cooperation portion 303. The surface of the first cooperation portion 302 cooperates with (e.g., contact, engage, etc.) the outer surface of the second portion 242 to constrain the movement of the conductive terminal 200 along directions L1 and L2 in the insulative housing, such as the forward, upward and downward movement. The cooperation of the surface of the first cooperation portion 301 with the outer surface of the second portion 242 may also provide improved guidance in the process of installing the conductive terminal 200 in the insulative housing 301. In another embodiment, the first cooperation portion 302 may have a groove (see FIG. 5). The second portion 242 is adapted to be received at least partially in the groove of the first cooperation portion 302 such that an outer surface of the second portion 242 cooperates with an inner surface of the groove, thereby restricting the movement of the conductive terminal 200 along the directions L1 and L2 in the insulative housing 301. The surface of the second cooperation portion 303 of the insulative housing 301 defines a depression portion (e.g., an L-shaped depression portion as illustrated). The first portion 241 may be at least partially received in the depression portion to constrain the movement of the first portion 241 along the direction L1, therefore further constraining the movement of the conductive terminal 200 along the direction L1 (e.g., the backward movement). In some embodiments, in order to facilitate the installation of the conductive terminal 200 in the insulating housing 301, the second cooperation portion 303 may be made of an elastic material, thereby defining an elastic latch. Thus, in the process of installing the conductive terminal 200 and its blocking portion 240 into the insulating housing 301, the second cooperation 303 may deform upwardly from the original shape when contacting the blocking portion 240 to provide a path for passing, and then return to the original shape after the blocking portion 240 passes, thereby restricting the movement of the conductive terminal 200. In some embodiments, the first cooperation portion 302 may be integrally formed with the second cooperation portion 303 such that the conductive terminal 200 is installed in the insulating housing 301 from the same installation directions, or the first cooperation portion 302 and the second cooperation portion 303 may be formed separately such that the conductive terminal 200 is installed in the insulating housing 301 from two installation directions.

Referring again to FIG. 2, in the illustrated embodiment, the second portion 242 of the blocking portion 240 further includes a flange 243 extending outwardly from its end. The flange 243 can increase the cooperation area of the blocking portion 240 (and thus the conductive terminal 200) and the insulating housing 301, thereby providing a more reliable fixing structure subject to larger force, and better constraining the movement of the conductive terminal and providing better guidance.

In some embodiments, a profile of an outer surface of the second portion 242 may be at least partially complementary to a profile of an inner surface of the insulative housing 301. For example, the outer surface of the second portion 242 and the surface of the first cooperation portion 302 of the insulative housing 301 may have complementary profiles, such as a linear shaped cross section (as shown in FIGS. 2 through 4), a curve shaped cross section (e.g., arc shape or the like). The complementary profiles can provide improved force and fix effect (e.g., more uniform distribution of forces, sealingly engagement or the like) when the second portion 242 cooperates with the insulative housing 301.

As shown in FIGS. 2 and 3, an end of the second portion 242 may be located above the mating portion 210. In another embodiment, an end of the second portion 242 may abut against the mating portion 210. Further, the crimping portions 220, 230 include a first crimping portion 220 adapted to crimp on a bare conductor of the wire and a second crimping portion 230 located behind the first crimping portion 220 and adapted to crimp on an outer insulation of the wire, respectively. The first crimping portion 220 may include a U-shaped base and a pair of flanks 222 extending from both sides of the U-shaped base, and/or the second crimping portion 230 may include a U-shaped base and a pair of flanks 232 extending from both sides of the U-shaped base. As shown in FIG. 2, the mating portion 210 of the conductive terminal 200 defines an insertion cavity and has a pair of resilient contact arms 212, the pair of resilient contact arms 212 adapted to clamp a mating terminal inserted into the insertion cavity.

Referring generally to FIGS. 2, 3 and 4, the entire conductive terminal 200 may be a single metal component made of a single metal sheet. For example, a single metal sheet can be made into the conductive terminal 200 through processes such as stamping, bending or the like.

Figure 5:
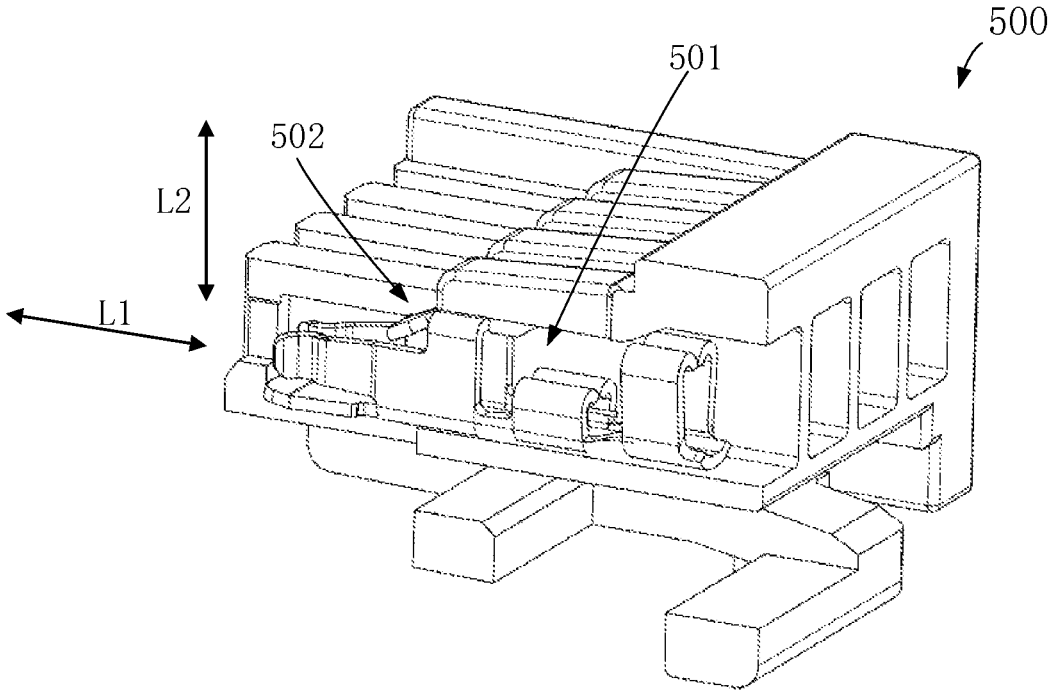
FIG. 5 is a perspective view of a connector including a conductive terminal and an insulating housing according to embodiments of the present invention.

FIG. 5 illustrates a perspective view of a connector 500 including a conductive terminal 501 and an insulating housing 502 according to embodiments of the present invention. For example, the conductive terminal 501 may be the conductive terminal 200 as shown and described with respect to FIGS. 2 through 4, and the insulative housing 502 may be the insulative housing 301 of FIGS. 3 and 4. Compared with the connector 100 of FIG. 1 of the prior art, after the conductive terminal 501 is installed in the insulating housing 502 of the connector 500 to a predetermined position, the movement of the conductive terminal 501 along the directions L1 and L2 is restricted due to the cooperation between the blocking portion of the conductive terminal 501 and the insulating housing 502. That is, the conductive terminal will be unable to move forwardly and the movement in forward, backward, upward and downward directions will be constrained, thereby avoiding the problem of poor conductivity due to the inability of a conductive terminal to be fixed in an insulative housing, ensuring contact reliability of the conductive terminal, and providing improved guidance in the process of installing the conductive terminal in an insulative housing. As illustrated, the housing 502 may define a plurality of grooves formed through a top wall thereof, wherein a part of the second portion of the illustrated terminal 501 is arranged within the groove.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A conductive terminal for installing into an insulative housing of an electrical connector, comprising:

a mating portion located proximate a front of the conductive terminal for engaging with a corresponding terminal of a mating connector;

a crimping portion located proximate a rear of the conductive terminal for crimping to a wire; and a blocking portion extending from the terminal and arranged between the mating portion and the crimping portion, the blocking portion includes a first portion extending from at least one of two sides of the conductive terminal and a second portion extending from the first portion, at least a part of the second portion extends obliquely relative to the first portion, the second portion engages with the insulative housing to constrain a movement of the conductive terminal within the insulative housing in a longitudinal direction and in a direction perpendicular to the longitudinal direction.

2. The conductive terminal according to claim 1, wherein the first portion extends from each of the two sides of the conductive terminal.

3. The conductive terminal according to claim 1, wherein the first portion extends to a height above the mating portion.

4. The conductive terminal according to claim 3, wherein the first portion is a protruding sidewall of the terminal.

5. The conductive terminal of claim 1, wherein the second portion extends obliquely downward from the first portion in a direction toward the mating portion.

6. The conductive terminal of claim 5, wherein an end of the second portion abuts against or is located above the mating portion.

7. The conductive terminal according to claim 6, wherein the second portion includes a flange extending laterally outward from an end of the second portion.

8. The conductive terminal according to claim 1, wherein the first and second blocking portions are formed integrally with a remainder of the terminal.

9. The conductive terminal according to claim 1, wherein a profile of an outer surface of the second portion is at least partially complementary to a profile of an inner surface of the insulative housing.

10. The conductive terminal of claim 1, wherein the first portion is adapted to engage with an elastic latch of the insulative housing.

11. The conductive terminal of claim 1, wherein the mating portion includes a pair of resilient contact arms defining an insertion cavity and are adapted to clamp to a mating terminal inserted into the insertion cavity.

12. A connector, comprising:

an insulative housing; and a conductive terminal installed within the insulative housing, the conductive terminal comprising:

a mating portion located at a front of the terminal for receiving a terminal of a mating connector; and a blocking portion engaging with the insulative housing to constrain a movement of the conductive terminal within the insulative housing in a longitudinal direction and in a direction perpendicular to the longitudinal direction, the blocking portion includes a first portion extending from at least one of two sides of the terminal and a second portion extending from the first portion, at least a part of the second portion is oriented at an angle relative to the first portion and the part of the second portion engages the insulative housing in the longitudinal direction and in the direction perpendicular to the longitudinal direction.

13. The connector of claim 12, wherein the insulative housing defines an elastic latch engaging with the first portion, and an inner surface engaging with the second portion.

14. The connector of claim 13, wherein the inner surface defines a complementary angled surface engaging with the second portion along at least a section of a length of the second portion.

15. The connector of claim 14, wherein the first portion extends upwardly to a height greater than a height of the mating portion, and the second portion extends obliquely downward from the first portion in a direction toward the mating portion.

16. The connector of claim 12, wherein an end of the second portion abuts against the mating portion.

17. The connector of claim 12, wherein the second portion is at least partially received in a groove formed in the insulative housing.

* * * * *